US005211471A

United States Patent [19]

Rohrs

[11] Patent Number: 5,211,471

[45] Date of Patent: May 18, 1993

[54] FLASHLIGHT WITH TAILCAP SWITCH BOOT

[75] Inventor: Donald L. Rohrs, Overland Park, Kans.

[73] Assignee: The Brinkmann Corporation, Dallas, Tex.

[21] Appl. No.: 635,030

[22] Filed: Dec. 28, 1990

[51] Int. Cl.[5] ..... F21L 7/00

[52] U.S. Cl. ..... 362/206; 362/205; 200/60; 200/302.2

[58] Field of Search ..... 362/158, 157, 202-206; 200/60, 302.2, 333

[56] References Cited

U.S. PATENT DOCUMENTS

| | | | |
|---|---|---|---|
| Re. 29,047 | 11/1976 | Brindley | 240/10.66 |
| 1,603,272 | 10/1926 | Eaton | 362/202 |
| 2,176,301 | 10/1939 | Haas | 362/158 |
| 2,451,176 | 10/1948 | Schellman | 200/168 |
| 2,790,881 | 4/1957 | Schueler | 200/168 |
| 3,054,879 | 9/1962 | Soreng | 200/159 |
| 3,316,379 | 4/1967 | Clark et al. | 200/168 |
| 3,459,907 | 8/1969 | Garland | 200/60 |
| 3,790,734 | 2/1974 | Raab et al. | 200/302.2 |
| 3,924,116 | 12/1975 | Brindley | 240/10.6 R |
| 3,924,117 | 12/1975 | Brindley | 200/60 |
| 4,286,311 | 8/1981 | Maglica | 362/205 |
| 4,399,495 | 8/1983 | Leopoldi et al. | 362/189 |
| 4,680,682 | 7/1987 | Parker | 362/205 |
| 4,766,272 | 8/1988 | Guzzon | 200/302.2 |
| 4,841,417 | 6/1989 | Maglica et al. | 362/206 |
| 4,905,129 | 2/1990 | Sharrah | 362/206 |
| 4,914,555 | 4/1990 | Gammache | 362/202 |

*Primary Examiner*—James C. Yeung
*Attorney, Agent, or Firm*—Pretty, Schroeder, Brueggemann & Clark

[57] ABSTRACT

A flashlight includes a tailcap switch and a flexible boot made of an elastomeric material covering the tailcap switch and providing a water-resistant and contaminant-resistant shield around the switch. The flexible boot preferably includes a substantially cylindrical bellows section and a flat exterior end surface with at least one substantially straight edge on the circumference of the end surface that reduces any tendency of the flashlight to roll when laid on its side.

3 Claims, 2 Drawing Sheets

FLASHLIGHT WITH TAILCAP SWITCH BOOT

BACKGROUND OF THE INVENTION

1. Field of the Invention

This invention relates generally to flashlights and, more particularly, to flashlights with what are commonly referred to as tailcap switches.

2. Description of the Related Art

Flashlights having cylindrical bodies and pushbutton switches for opening and closing the electrical circuit between the flashlight bulb and the batteries, thereby switching the flashlight on and off, are well known. Some of these pushbutton switches advantageously comprise what are known as tailcap switches, in which the switch for opening and closing the electrical circuit is positioned in the tailcap of the flashlight so that the flashlight can be held by its body and switched on and off with the same hand. An example of such a switch with a rotatable locking feature suitable for use in a flashlight tailcap is described in co-pending application Ser. No. 07/566,888 filed Aug. 13, 1990, U.S. Pat. No. 5,091,611 and assigned to the same assignee as the present application.

Durability and reliability are two important attributes of flashlight design. Conventional tailcap switches generally include a switch plunger that projects from the end of the flashlight body and that, therefore, is vulnerable to damage during handling and use. Some flashlights provide a tailcap switch that is recessed to prevent such damage. Unfortunately, this can make the switch difficult to operate.

Another concern of flashlight design is maintaining a water-resistant and contaminant-resistant construction to keep moisture and dirt out of the flashlight body and minimize corrosion and fouling. Because at least part of a tailcap switch must be operable from outside the flashlight body, such a switch generally is vulnerable to moisture or dirt penetration, which may render the switch inoperative. It is highly desirable for tailcap switches to embody as water-resistant and contaminant-resistant a construction as the remainder of the flashlight body.

From the foregoing discussion, it should be apparent that there is a need for a flashlight with a tailcap switch of economical construction that is resistant to damage and entry of water and dirt, while at the same time being easy to operate. The present invention satisfies this need.

SUMMARY OF THE INVENTION

Briefly, and in general terms, the present invention provides a flashlight with a tailcap switch actuated by a plunger that includes a flexible boot extending over the tailcap switch to provide a water-resistant and contaminant-resistant seal around the switch and to protect it against damage. In a further aspect of the invention, the boot may be configured to reduce the tendency of the flashlight body to roll when laid on its side.

More particularly, in a presently preferred embodiment, the boot has a construction making it resiliently flexible in the longitudinal direction of switch actuation, while presenting a cushioning resistance to any lateral force or blow that might be applied to the switch actuator. Such largely unidirectional flexibility is advantageously provided in the preferred embodiment by a boot made of a resilient elastomeric material molded in a generally cylindrical configuration with a bellows-like construction. The boot is open at one end for sealing attachment around the tailcap switch and is closed at the other end to provide an actuation surface for the user. Flatted edges along the circumference of the closed end of the boot help to prevent flashlights with cylindrical bodies from rolling off generally horizontal surfaces, such as tables and the like, and becoming damaged as the result of falling to the floor.

Other features and advantages of the invention should be apparent from the following more detailed description of the preferred embodiments, which illustrate, by way of example, the principles of the invention.

DESCRIPTION OF THE PREFERRED EMBODIMENT

Figure 1:
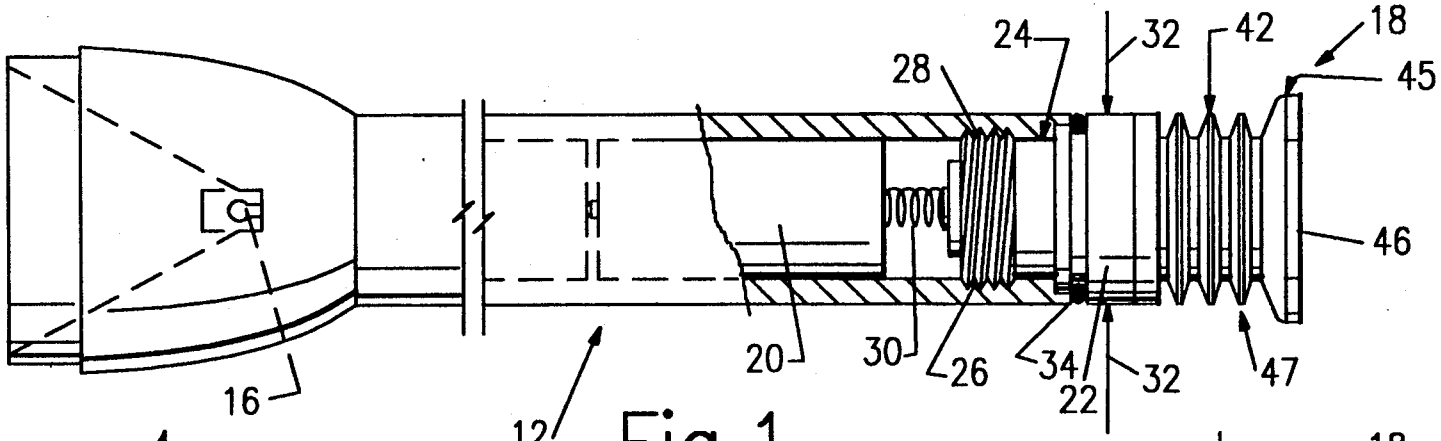
FIG. 1 shows a partial side elevation, partial sectional view of a flashlight having a tailcap switch boot in accordance with the invention.

Turning now to the drawings, and particularly FIG. 1 thereof, there is shown a flashlight 10 in accordance with the present invention including a cylindrical barrel or battery cell tube 12 with a head assembly 14 enclosing a bulb 16 at one end and a tailcap assembly 18 at the other end. Except as described below, some or all of the housing parts of the flashlight, including the barrel, may be usefully formed of metal so as to provide a path for electrical conduction. The barrel 12 is appropriately sized to retain one or more dry cell batteries 20 in series. The head assembly 14 may advantageously include a reflector and lens retained in place by a removable face cap and may be attached to the barrel 12 by screw threads or the like to allow the head to be translated longitudinally to adjust the dispersion of the light beam emanating from the bulb in well-known fashion, none of the details of which are shown as they are conventional and form no part of the present invention.

Figure 2:
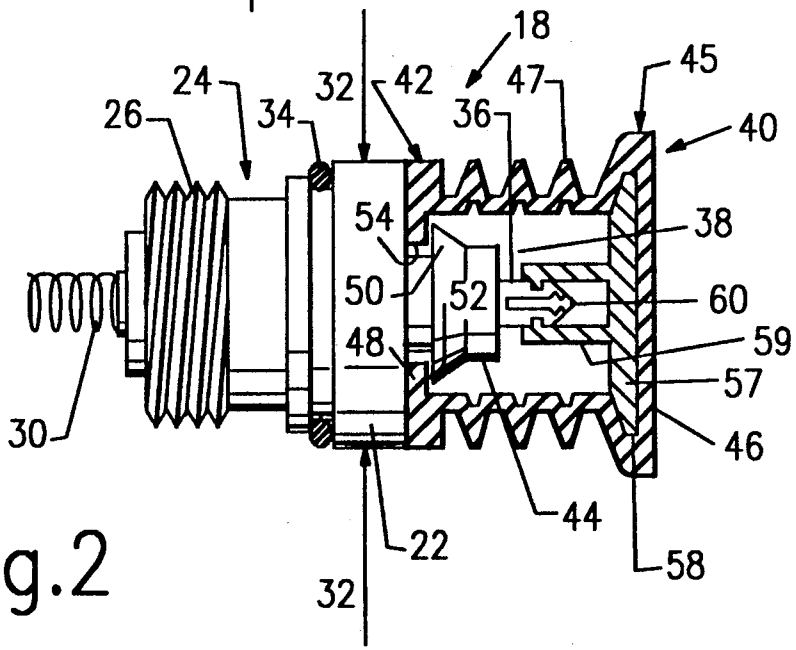
FIG. 2 is a sectional view of the tailcap switch boot for the flashlight shown in FIG. 1.

Referring to FIGS. 1 and 2, the tailcap assembly 18 includes a generally cylindrical switch housing 22 that encloses a pushbutton switch mechanism. One end 24 of the switch housing 22 has a reduced-diameter threaded portion 26 for engaging complementary threads 28 formed in the inside of the barrel 12 to removably secure the tailcap assembly 18 in the end thereof and retain the batteries in place. This end of the switch housing 22 carries a spring 30 to urge the batteries into series contact and make electrical connection with the adjacent electrode of the rearwardmost battery 20. The switch housing 22 has an outer diameter indicated by arrows 32 of appropriate size such that when it is screwed into the barrel 12, the outside circumference of the switch housing will be substantially flush with the outside circumference of the barrel. An O-ring 34 is installed in a groove formed near the bottom of the threaded portion 26 of the switch housing to seal the threaded connection between the switch housing and the barrel.

A switch plunger 36 that can be actuated by pushing longitudinally to switch the bulb 16 on and off protrudes out of the other end 38 of the switch housing 22. The details of the switch mechanism likewise form no part of the present invention and therefore are not shown. A preferred switch mechanism is described in the aforementioned pending application, Ser. No. 07/566,888, U.S. Pat. No. 5,091,611 which is hereby incorporated by reference, except that when used with the boot of the present invention no rotatable locking feature for the switch mechanism is contemplated.

The protruding nature of the switch plunger 36 makes it vulnerable to damage in use. Moreover, because the switch plunger projects out the end 38 of the switch housing 22 and must move longitudinally for actuation of the switching mechanism, the interface between the switch plunger and the switch housing is necessarily subject to possible invasion by moisture or dirt. Such invasion could impair the operation of the switch mechanism or even render it completely inoperative. To alleviate these concerns, a boot 40 made of a resilient elastomeric material is mounted over the end 38 of the switch housing 22 in accordance with the present invention so as to completely enclose and shield the switch plunger 36.

The boot 40 has a generally cylindrical bellows configuration for longitudinal compressibility. The boot is open at one end where an attachment portion 42 (described below) is formed to sealingly attach the boot to a reduced-diameter projection 44 formed on the end 38 of the switch housing 22 surrounding the switch plunger 36, and is closed at the other, flatted end 45 where an essentially flat outer surface 46 is formed for the user to push against to actuate the switch plunger and thus operate the pushbutton switch mechanism. The bellows section 47 extends between the attachment end and the flatted end. In the preferred embodiment, the boot is preferably economically molded in thermoplastic rubber (TPR) for integrity.

The resiliency of the boot 40 adds to the spring force of the switch mechanism to make the switch more resistant to accidental operation. The boot also muffles the sound of the switch mechanism, making the switch operation quieter. Finally, the boot also improves the sealing against moisture and dirt by equalizing the pressure between the external environment and inside the boot and flashlight. For example, when the flashlight 10 is submerged, the boot deflects inward at the bellows section 47, tending to equalize the pressure inside the flashlight with the higher pressure outside. At high altitudes, the boot expands, tending to equalize the pressure inside the flashlight with the lower pressure outside. This equalizing action reduces the pressure differential across the O-ring seals of the flashlight and consequently improves their sealing function.

Referring to FIG. 2, the attachment portion 42 of the boot 40 includes an inwardly projecting circumferential lip 48. The reduced-diameter projection 44 on the end 38 of the switch housing 22 has a radially extending conical ridge 50 with a flat undercut 52 forming a groove 54 therein. To attach the boot 40 to the switch housing 22, the boot is slid over the conical ridge 50 of the projection 44 until the circumferential lip 48 stretches over the conical ridge and snaps into the groove 54 to produce a seal against unwanted moisture and dirt. If desired, the boot can be permanently fixed to the switch housing 22 by application of glue or some other fastening agent.

Figure 3:
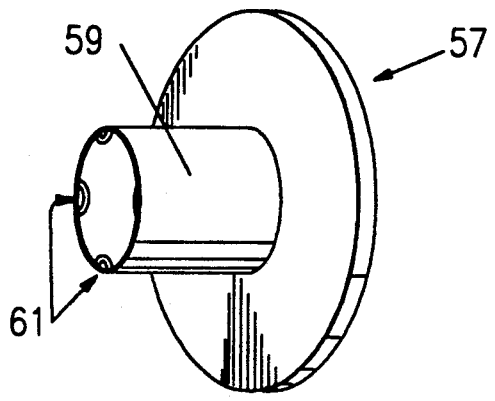
FIG. 3 is a perspective view of a boot support for the boot shown in FIG. 2.

Referring to FIGS. 2 and 3, a boot support 57 is provided from a rigid material such as ABS plastic, commonly known to those skilled in the art, and is inserted in the boot 40 to distribute the actuation pressure applied by the user to the boot and to provide a non-resilient attachment of the boot to the switch plunger 36. The boot support 57 has a flat disk portion having a diameter larger than that of the internal diameter of the bellows section 47, so as to fit beneath an undercut 58 molded into the boot, and also includes a cylindrical projection 59 forming a longitudinal recess. The undercut serves to hold the support in position within the boot.

The plunger 36 of the tailcap switch extends beyond the cylindrical projection 38 of the switch housing 22 to be received in the cylindrical projection 59 when the boot 40 is installed. The plunger 36 includes a pair of outwardly extending prongs 60 that snap into the cylindrical projection 59 and mate with inwardly protruding ribs 61 to provide a secure coupling between the boot 40 and the switch plunger 36. The boot support alternatively can be coupled to the boot, for example, by gluing. When the flatted end 45 of the boot thus is pressed by hand longitudinally, the bellows construction of the boot allows it to compress so that the plunger may be depressed and the tail cap switch actuated.

Figure 4:
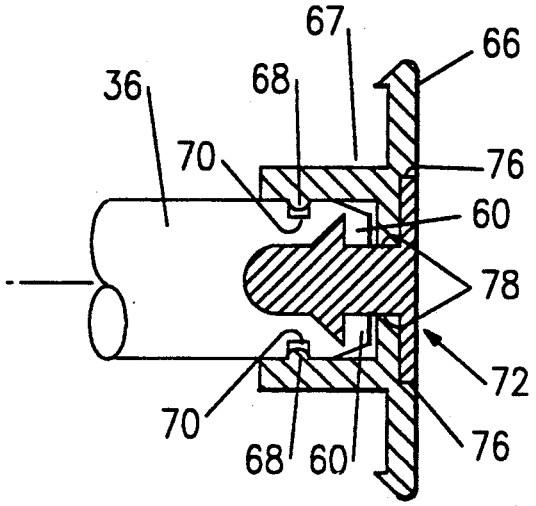
FIG. 4 is a sectional view of an alternate switch plunger-boot support attachment for the boot shown in FIG. 2.
Figure 5:
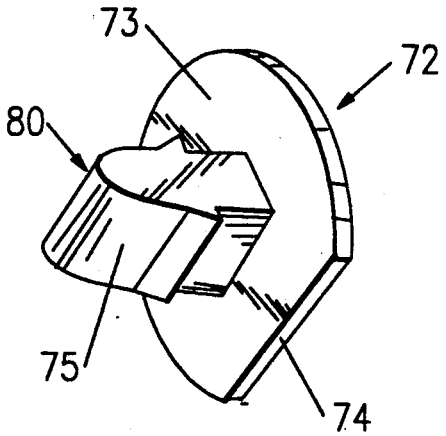
FIG. 5 is a perspective view of a boot support lock for the boot support shown in FIG. 4.

Referring to FIGS. 4 and 5, an alternate and preferred construction is shown for coupling the switch mechanism and the boot 40 together. In FIG. 4, the boot has been removed for clarity, illustrating that the preferred boot support 66 again includes a cylindrical projection 67 forming a longitudinal recess with inwardly protruding ribs 68 that are received in indentations 70 in the switch plunger 36, but also has an opening through its center to receive a boot support lock described below. The boot support 66 again has a diameter larger than that of the internal diameter of the bellows section 47, so as to fit beneath the undercut 58 molded into the boot 40.

A boot support lock 72 shown relatively enlarged in FIG. 5 has a base 73 that is circular in shape except for a straight edge 74 and has a perpendicularly projecting portion 75. A bottom part 76 of the opening in the boot support has a shape matching that of the boot support lock base, being circular except for a straight edge, to receive the base and properly orient it. The remainder of the boot support opening has a rectangular cross-section 78 to allow the rectangular section of the boot lock projection 75 to pass through.

The boot support lock 72 has an oblique, arrowhead-shape 80 at one end that snaps into the outwardly extending prongs 60 of the switch plunger 36, locking the plunger, support lock, and boot support 66 together to act as a single unit. The combination is similar to that disclosed in the above-referenced, co-pending patent application. In this way, the boot support 66, support lock 72, and switch plunger 36 will not become separated, even if a lateral or oblique force is applied to the boot.

It will be appreciated that while the boot 40 readily permits a longitudinal switching operation, it presents a relatively firm, yet resilient structure that cushions the switch plunger 36 against lateral forces or blows due to its rigid attachment at one end to the switch housing 22 and its solid flatted other end portion 45. As a result, the risk of damage to the switch plunger as the result of dropping the flashlight or banging it against another object is greatly diminished.

Figure 6:
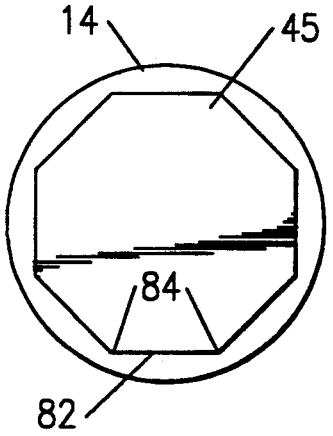
FIG. 6 is an end view of the tailcap switch boot of the flashlight shown in FIG. 1.

Referring now to FIG. 6, the flatted end portion 45 of the boot 40 preferably has a shape with circumferential straight edges 82, such as the octagonal shape shown, to resist rolling over from a resting position. For example, when a particular straight edge 82 is resting on a tabletop (not shown), the end points 84 of the edge resist any tendency for the head 14 of the flashlight 10 to rotate. Thus, the flashlight tends to remain in its resting position, reducing the chance of the flashlight rolling off the table.

The present invention has been described above in terms of a presently preferred embodiment so that an understanding of the invention can be conveyed. There are, however, many configurations for flashlights not specifically described herein, but with which the present invention is applicable. The present invention should therefore not be seen as limited to the particular embodiments described herein, but rather, it should be understood that the present invention has wide applicability with respect to flashlights with tailcap switches. Such other configurations can be achieved by those skilled in the art in view of the descriptions herein. Accordingly, the scope of the invention is defined by the following claims.

I claim:

1. A flashlight comprising:

a housing for retaining one or more batteries;

a head assembly attached to one end of said housing, said head assembly enclosing a bulb;

a tailcap assembly attached to an opposite end of said housing, said tailcap assembly including a switch for selectively completing or breaking an electrical circuit between the bulb and the batteries, and further including a switch plunger operatively coupled at one end to said switch and having an opposite end projecting from the tail cap assembly; and a boot assembly including a generally hollow and resilient boot attached at an open end to said tailcap assembly, said boot having an opposite closed end with a substantially flat exterior surface, said boot assembly further including a rigid boot support within said boot adjacent said closed end thereof, said boot support including means defining a recess into which said opposite end of said switch plunger is received, wherein said tailcap assembly includes a generally cylindrical and outwardly-extending projection and said boot includes at its open end an inner circumferential lip that mates with said projection to provide a water-resistant and contaminant-resistant seal for said switch.

2. A flashlight as defined in claim 1, wherein said opposite end of said switch plunger and said recess in said boot support disk are configured to mate with an interlocking interference fit.

3. A flashlight as defined in claims 1 or 2, wherein said boot support includes a projection extending toward said switch plunger, said recess being formed in said projection.

* * * * *